United States Patent [19]

Stange et al.

[11] Patent Number: 4,940,514

[45] **Date of Patent: * Jul. 10, 1990**

[54] MAKING PAPER, BOARD AND CARDBOARD OF HIGH DRY STRENGTH

[75] Inventors: Andreas Stange, Mannheim; Hans-Juergen Degen, Lorsch; Werner Auhorn, Frankenthal; Volkmar Weberndoerfer; Michael Kroener, both of Mannheim; Heinrich Hartmann, Limburgerhof, all of Fed. Rep. of Germany

[73] Assignee: BASF Aktiengesellschaft, Ludwigshafen, Fed. Rep. of Germany

[ * ] Notice: The portion of the term of this patent subsequent to Apr. 4, 2006 has been disclaimed.

[21] Appl. No.: 223,334

[22] Filed: Jul. 25, 1988

[30] Foreign Application Priority Data

Jul. 25, 1987 [DE] Fed. Rep. of Germany ..... 3724646

[51] Int. Cl.[5] ..... D21H 17/44

[52] U.S. Cl. ..... 162/168.2; 162/168.3; 162/168.4; 162/168.5; 162/175

[58] Field of Search ..... 162/175, 168.2, 164.6, 162/168.3, 168.4, 168.5, 168.6; 106/210, 213

[56] References Cited

U.S. PATENT DOCUMENTS

| | | | |
|---|---|---|---|
| 2,433,285 | 12/1947 | Marrone | 162/175 |
| 3,734,820 | 5/1973 | Hoover et al. . | |
| 4,097,427 | 6/1978 | Aitken et al. . | |
| 4,146,515 | 3/1979 | Buikema et al. | 162/175 |
| 4,421,602 | 12/1983 | Brunnmueller et al. . | |
| 4,818,341 | 4/1989 | Degen et al. | 162/175 |

FOREIGN PATENT DOCUMENTS

| | | |
|---|---|---|
| 3534273 | 11/1962 | Fed. Rep. of Germany . |
| 976547 | 4/1962 | United Kingdom . |

OTHER PUBLICATIONS

Casey, *Pulp and Paper*, 2 ed., vol. II, (1960) p. 947.

Casey, *Pulp and Paper*, 3rd ed., vol. III, (1981) p. 1689.

TAPPI, band 58, nr. 1, Jan. 1975, pp. 106–108, J. C. Rankin et al., "Enzyme-Converted Cationic Flours and Starches: Paper Surface Sizing . . . ".

*Primary Examiner*—Peter Chin

*Attorney, Agent, or Firm*—Oblon, Spivak, McClelland, Maier & Neustadt

[57] ABSTRACT

Paper, board, and cardboard having high dry strength are made by adding to the paper stock a dry strength agent which is obtainable by mixing enzymatically digested starch having a viscosity of from 20 to 2,000 mPa.s (measured in 7.5% strength aqueous solution at 45° C.) and a cationic polymer which contains, as typical copolymerized monomers, (a) diallyldimethylammonium chloride, (b) N-vinylamine or (c) an unsubstituted or substituted N-vinylimidazoline, the K value of the cationic polymer in each case being not less than 30, and draining the paper stock with sheet formation.

6 Claims, No Drawings

MAKING PAPER, BOARD AND CARDBOARD OF HIGH DRY STRENGTH

To increase the dry strength of paper it is known to add aqueous suspensions of natural starches which are converted into a water-soluble form by heating to the pulp during papermaking. However, the retention of the starches dissolved in water by the paper fibers in the paper stock is poor. An improvement of the retention of natural products by cellulose fibers during papermaking is disclosed in, for example, U.S. Pat. No. 4,734,820, which describes graft copolymers which are prepared by grafting dextran, a naturally occurring polymer having a molecular weight of from 20,000 to 50 million, with cationic monomers, eg. diallyldimethylammonium chloride, mixtures of diallyldimethylammonium chloride and acrylamide or mixtures of acrylamide and basic methacrylates, such as dimethylaminoethyl methacrylate. The graft polymerization is preferably carried out in the presence of a redox catalyst.

U.S. Pat. No. 4,097,427 discloses a process for the cationization of starch, in which the digestion of starch is carried out in an alkaline medium in the presence of water-soluble quaternary ammonium polymers and an oxidizing agent. Quaternary ammonium polymers include quaternized diallyldialkylamine polymers or quaternized polyethyleneimines. The oxidizing agents used are, for example, ammonium persulfate, hydrogen peroxide, sodium hypochlorite, ozone or tert-butyl hydroperoxide. The modified cationic starches which can be prepared in this manner are added as dry strength agents to the paper stock during papermaking. However, the wastewater has a very high COD value.

It is an object of the present invention to achieve an improvement in the dry strength of paper using starch, in comparison with the known processes. In particular, it is intended to increase the substantivity of the starch during adsorption onto the fibers in the paper stock, and hence to reduce the COD in the wastewater.

We have found that this object is achieved, according to the invention, by a process for making paper, board and cardboard of high dry strength by adding a dry strength agent to the paper stock and draining the paper stock with sheet formation, if the dry strength agent used is an aqueous solution of a mixture of an enzymatically digested starch having a viscosity of from 20 to 2,000 mPa.s (measured in 7.5% strength aqueous solution at 45° C.) and a cationic polymer which contains, as copolymerized characteristic monomers, (a) diallyldimethylammonium chloride, (b) N-vinylamine or (c) an N-vinylimidazoline of the formula

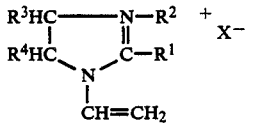

(I)

where $R^1$ is H, $C_1$–$C_{18}$-alkyl or

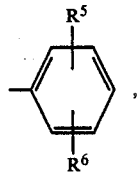

$R^5$ and $R^6$ are each H, $C_1$–$C_4$-alkyl or Cl, $R^2$ is H, $C_1$–$C_{18}$-alkyl,

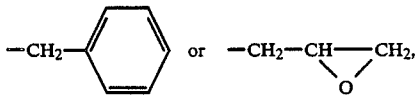

$R^3$ and $R^4$ are each H or $C_1$–$C_4$-alkyl and $X^-$ is an acid radical, and which has a K value of not less than 30 (determined according to H. Fikentscher in 5% strength by weight aqueous sodium chloride solution at 25° C. and at a polymer concentration of 0.5% by weight).

The mixtures to be used according to the invention as dry strength agents have good retention with respect to paper fibers in the paper stock. The COD value in the backwater is substantially reduced by the mixtures to be used according to the invention, in comparison with a natural starch or an enzymatically digested starch. The troublesome substances present in the circulations of paper machines have only a slight adverse effect on the effectiveness of the dry strength agents to be used according to the invention. The pH of the stock suspensions may be from 4 to 9, preferably from 6 to 8.5.

Enzymatically digested starches are an important component of the mixtures. All natural starches are suitable for the preparation of the mixtures, for example natural potato starch, wheat starch, corn starch, rice starch and tapioca starch. The starches are digested with the aid of enzymes, for example α-amylase from *Aspergillus oryzae* or from *Bacillus lichemiformis* or amyloglucosidase from *Aspergillus niger*, by known methods in which an aqueous suspension of natural starch or of a mixture of a plurality of natural starches in water is first prepared. The suspension is prepared using from 0.1 to 60 parts by weight of starch per 100 parts by weight of water. From 0.0001 to 1 part by weight, per 100 parts by weight of the suspension, of an enzyme customarily used for the digestion of natural starches is then added to these starch suspensions. The aqueous suspensions of starch and enzyme are heated to about 100° C. with thorough mixing. The enzymatic digestion of the starch takes place in the temperature range up to about 90° C. The degree of digestion of the natural starch depends on the rate of heating of the reaction mixture, the residence time at a certain fairly high temperature and the amount of enzyme used. The progress of the digestion of the natural starch can readily be determined by taking samples of the mixture and measuring the viscosity of the samples. As soon as the desired degree of digestion of the starch has been reached, the enzyme is deactivated. Deactivation is most easily effected by heating the reaction mixture to above 90° C., for example 92°–98° C. At these temperatures, the enzymes lose their activity, so that the enzymatic digestion then ceases. The resulting aqueous solution of the enzymatically digested starch is then cooled, for example to 70° C., if necessary diluted with water and then mixed with the cationic polymers, the dry strength agent for papermaking being obtained. The concentration of the enzymatically digested starch in the aqueous solution which is then mixed with the cationic polymer is from 40 to 0.5% by weight. The enzymatic digestion is continued until the resulting aqueous solutions of enzymatically digested starch have a viscosity of from 20 to 2,000, preferably from 25 to 1,500, mPa.s (measured in 7.5% strength aqueous solution at 45° C.).

The aqueous solution of the enzymatically digested starch is then combined with the cationic polymers described above. This is most easily done by mixing the aqueous solution of the said starch with the suitable cationic polymers in the form of an aqueous solution directly after the enzymatic digestion. The enzymatically digested starch can be mixed with the cationic polymers at from 15° to 170° C.; at above 100° C., the reaction is carried out in a pressure-tight apparatus. The two components are preferably mixed at from 40° to 100° C. in the course of from 1 to 60 minutes. Mixing of the enzymatically digested starch and the cationic polymers is always carried out in the absence of oxidizing agents, initiators and alkalis. All that is desired is thorough homogeneous mixing. From 1 to 20, preferably from 5 to 15, parts by weight of one or more cationic polymers are used per 100 parts by weight of an enzymatically digested starch or of a mixture of such starches. For example, a 25% strength by weight aqueous solution of the mixture consisting of enzymatically digested starch and cationic polymer and to be used as a dry strength agent has a viscosity of from 10 to 10,000 mPa.s (measured by the Brookfield method at 20 rpm and 80° C.).

Examples of suitable cationic polymers of group (a) are polymers of diallyldimethylammonium chloride. Polymers of this type are known.

Polymers of diallyldimethylammonium chloride are primarily the homopolymers and the copolymers with acrylamide and/or methacrylamide. The copolymerization can be carried out using any monomer ratio. The K value of the homopolymers and copolymers of diallyldimethylammonium chloride is not less than 30, preferably from 95 to 180.

Cationic polymers of group (b) which contain units of N-vinylamine as typical polymerized monomers are obtainable by hydrolyzing homopolymers of N-vinylformamide, from 70 to 100 mol % of the formyl groups of the homopolymers of N-vinylformamide being eliminated and polymers containing polymerized N-vinylamine units being formed. If 100 mol % of the formyl groups are eliminated from the homopolymers of N-vinylformamide, the resulting polymers may also be regarded as poly-N-vinylamines. This group of polymers includes hydrolyzed copolymers of (b1) from 95 to 10 mol % of N-vinylformamide and (b2) from 5 to 90 mol % of vinyl acetate or vinyl propionate, the sum of the data in mol % always being 100, and from 70 to 100 mol % of the formyl groups of the copolymer having been eliminated with formation of N-vinylamine units in the copolymers, and from 70 to 100 mol % of the acetyl and propionyl groups having been eliminated with formation of vinyl alcohol units. The K value of the hydrolyzed homopolymers and copolymers of N-vinylformamide is preferably from 70 to 170. The polymers belonging to this group are disclosed in, for example, U.S. Pat. Nos. 4,421,602, 4,444,667 and German Laid-Open Application DOS No. 3,534,273.

Suitable cationic polymers of group (c) are homopolymers and copolymers of unsubstituted or substituted N-vinylimidazolines. These are also known substances. They can be prepared, for example, by the process of German Published Application DAS No. 1,182,826, by polymerizing a compound of the formula

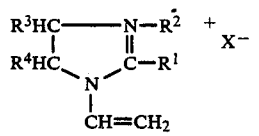

(I)

where $R^1$ is H, $C_1$–$C_{18}$-alkyl or

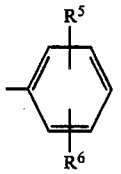

$R^5$ and $R^6$ are each H, $C_1$–$C_4$-alkyl or Cl, $R^2$ is H, $C_1$–$C_{18}$-alkyl,

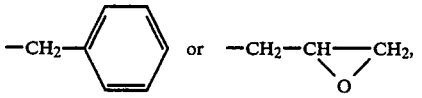

$R^3$ and $R^4$ are each H or $C_1$–$C_4$-alkyl and $X^-$ is an acid radical, with or without acrylamide and/or methacrylamide, in an aqueous medium at a pH of from 0 to 8, preferably from 1.0 to 6.8, in the presence of a polymerization initiator which decomposes into free radicals.

1-vinyl-2-imidazoline salts of the formula II

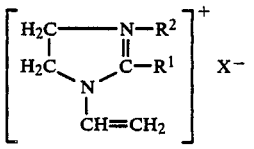

(II)

where $R^1$ is H, $CH_3$, $C_2H_5$, n-$C_3H_7$, i-$C_3H_7$ or $C_6H_5$ and $X^-$ is an acid radical, are preferably used in the polymerization. $X^-$ is preferably $Cl^-$, $Br^-$, $SO_{42}$—, $CH_3O$—$SO_3H^-$, $C_2H_5$—O—$SO_3H^-$ or R-$COO^-$ and $R^2$ is H, $C_1$–$C_4$-alkyl or aryl.

The substituent $X^-$ in the formulae I and II can in principle be any acid radical of an inorganic or of an organic acid. The monomers of the formula I are obtained by neutralizing the free base, i.e. a 1-vinyl-2-imidazoline, with the equivalent amount of an acid. The vinylimidazolines can also be neutralized, for example, with trichloroacetic acid, benzenesulfonic acid or toluenesulfonic acid. In addition to salts of 1-vinyl-2-imidazolines, quaternized 1-vinyl-2-imidazolines are also suitable. They are prepared by reacting 1-vinyl-2-imidazolines, which may be substituted in the 2-, 4- and 5-position, with known quaternizing agents. Examples of suitable quaternizing agents are $C_1$–$C_{18}$-alkyl chlorides or bromides, benzyl chloride, benzyl bromide, epichlorohydrin, dimethyl sulfate and diethyl sulfate. Preferably used quaternizing agents are epichlorohydrin, benzyl chloride, dimethyl sulfate and methyl chloride.

For the preparation of the water-soluble homopolymers, the compounds of the formula I or II are preferably polymerized in an aqueous medium. The copolymers are obtained by polymerizing the monomeric compounds of the formulae I and II with acrylamide and/or methacrylamide. For the preparation of copolymers, the monomer mixture used in the polymerization contains not less than 1, preferably from 10 to 40, % by weight of a monomer of the formula I or II. Copolymers which contain from 60 to 85% by weight of acrylamide and/or methacrylamide and from 15 to 40% by weight of N-vinylimidazoline or N-vinyl-2-methylimidazoline as copolymerized units are particularly suitable for the modification of enzymatically digested starch.

The copolymers may be further modified by incorporating other monomers, such as styrene, vinyl acetate, vinyl propionate, N-vinylformamide, $C_1$–$C_4$-alkyl vinyl ethers, N-vinylpyridine, N-vinylpyrrolidone, N-vinylimidazole, acrylates, methacrylates, ethylenically unsaturated $C_3$–$C_5$-carboxylic acids, sodium vinylsulfonate, acrylonitrile, methacrylonitrile, vinyl chloride and vinylidene chloride, in amounts of up to 25% by weight, as copolymerized units. In addition to the polymerization in aqueous solution, it is also possible, for example, to prepare the homopolymers and copolymers in a water-in-oil emulsion. The monomers can also be polymerized by the process of inverse suspension polymerization, in which bead polymers are obtained. The polymerization is initiated with the aid of conventional polymerization initiators or by the action of high energy radiation. Examples of suitable polymerization initiators are hydrogen peroxide, inorganic and organic peroxides, and hydroperoxides and azo compounds. Mixtures of polymerization initiators as well as redox polymerization initiators can be used, for example mixtures of sodium sulfite, ammonium persulfate and sodium bromate, or mixtures of potassium peroxydisulfate and iron(II) salts. The polymerization is carried out at from 0° to 100° C., preferably from 15° to 80° C. It is of course also possible to carry out the polymerization at above 100° C., but in this case it is necessary to effect the polymerization under superatmospheric pressure. Temperatures of, for example, up to 150° C. are possible. The reaction time depends on the temperature. The higher the temperature at which the polymerization is carried out, the shorter is the time required for the polymerization.

Since the compounds of the formula I are relatively expensive, copolymers of compounds of the formula I with acrylamide or methacrylamide are preferably used as cationic polymers of group (c), for economic reasons. These copolymers contain the compounds of the formula I as copolymerized units only in effective amounts, i.e. in an amount of from 1 to 40% by weight. Copolymers of acrylamide with compounds of the formula I where $R^1$ is methyl, $R^2$, $R^3$ and $R^4$ are each H and X is an acid radical, preferably chloride or sulfate, are preferably employed for the preparation of the dry strength agents to be used according to the invention.

Other substances which are suitable for modifying enzymatically digested starches are copolymers of (c1) from 70 to 96.5% by weight of acrylamide and/or methacrylamide, (c2) from 2 to 20% by weight of N-vinylimidazoline or N-vinyl-2-methylimidazoline and (c3) from 1.5 to 10% by weight of N-vinylimidazole, having a K value of from 80 to 150, and the sum of the percentages by weight always being 100. These copolymers are prepared by free radical copolymerization of monomers (c1), (c2) and (c3) by the polymerization method described above.

The mixtures to be used according to the invention and consisting of the cationic polymers described above and enzymatically digested starch are added to the paper stock in an amount of from 0.5 to 5.0, preferably from 1.5 to 3.5, % by weight, based on dry stock. The pH of the mixture is from 2.0 to 9.0, preferably from 2.5 to 8.0. The solution of the dry strength agent in water has, at a solids content of 7.5% by weight, a viscosity of from 20 to 10,000, preferably from 30 to 4,000, mPa.s, measured in a Brookfield viscometer at 20 rpm and at 45° C.

The dry strength agents to be used according to the invention can be employed for making all known paper, cardboard and board grades, for example writing, printing and packaging papers. Papers can be made from a wide range of fiber materials, for example from sulfite or sulfate pulp in the bleached or unbleached state, groundwood, waste paper, thermomechanical pulp (TMP) and chemothermomechanical pulp (CTMP). The pH of the stock suspension is from 4.0 to 10, preferably from 6.0 to 8.5. The dry strength agents can be used both for making raw paper for papers having a low basis weight (LWC papers) and for cardboard. The basis weight of the papers is from 30 to 200, preferably from 35 to 150, g/m$^2$, while that of cardboard can be up to 600 g/m$^2$. Compared with papers made in the presence of the same amount of natural potato starch, the paper products produced according to the invention have markedly improved strength, which can be quantified, for example, with reference to the tear length, the bursting pressure, the CMT value and the tear strength.

In the Examples, parts and percentages are by weight. The viscosities of the strength agents were determined in aqueous solution at a solids content of 7.5% by weight at 45° C. in a Brookfield viscometer at 20 rpm; the viscosities of the enzymatically digested starches were determined in water at a concentration of 7.5% by weight and at 45° C., likewise in a Brookfield viscometer at 20 rpm.

The sheets were made in a Rapid-Köthen laboratory sheet former. The dry tear length was determined according to DIN 53,112, page 1, the Mullen dry bursting pressure according to DIN 53,141, the CMT value according to DIN 53,143 and the Brecht-Inset tear strength according to DIN 53,115.

The sheets were each tested after conditioning for 24 hours at 23° C. and a relative humidity of 50%.

The COD value was determined using COD Tester A from Grove Analysentechnik GmbH.

The K value of the polymers was determined according to H. Fikentscher, Cellulosechemie, 13 (1932), 58–64 and 71–74, at 25° C. in 5% strength aqueous sodium chloride solutions and at a polymer concentration of 0.5% by weight; $K=k \cdot 10^3$.

The following starting materials were used:

Polymer 1

Homopolymer of diallyldimethylammonium chloride, having a K value of 95.

Polymer 2

Homopolymer of diallyldimethylammonium chloride, having a K value of 110.

Polymer 3

Homopolymer of diallyldimethylammonium chloride, having a K value of 125.

Polymer 4

Copolymer of 90% by weight of acrylamide, 8% by weight of N-vinyl-2-methylimidazoline and 2% by weight of N-vinylimidazole, having a K value of 119.

Polymer 5

Copolymer of 25 mol % of N-vinyl-2-methylimidazoline and 75 mol % of acrylamide, having a K value of 117.

Polymer 6

Homopolymer of N-vinylformamide from which 99% of the formyl groups have been eliminated, having a K value of 83.

Polymer 7

Homopolymer of N-vinylformamide from which 83% of the formyl groups have been eliminated, having a K value of 168.

Polymer 8

Copolymer of 40% by weight of N-vinylformamide and 60% by weight of vinyl acetate, from which 100% of the formyl groups and 98% of the acetyl groups have been eliminated, having a K value of 75.

Strength agent 1

An enzyme (α-amylase from *Aspergillus oryzae*) is added to a 25% strength suspension of natural potato starch in water in an amount such that the resulting mixture contains 0.01%, based on natural potato starch used, of enzyme. This mixture is heated to 90°-95° C. in the course of 15 minutes, while stirring, and is then cooled to 70° C. The viscosity of the enzymatically digested natural potato starch is 24 mPa.s, measured at 45° C. in 7.5% strength aqueous solution.

An aqueous solution of polymer 1 is added to the aqueous solution of the enzymatic potato starch, cooled to 70° C., in an amount such that the resulting mixture contains 10%, based on enzymatically digested potato starch used, of polymer 1. The mixture is then stirred for a further 10 minutes at 70° C. and is used according to the invention as a dry strength agent by adding it to a stock suspension prior to sheet formation. The viscosity of the mixture is 82 mPa.s.

Strength agent 2

As described above under strength agent 1, a dry strength agent for paper is prepared by mixing a 25% strength aqueous solution of enzymatically digested potato starch (viscosity of a 7.5% strength aqueous solution at 45° C.=24 mPa.s) with the polymer 2 described above. A dry strength agent which has a viscosity of 108 mPa.s is obtained.

Strength agent 3

As described above under strength agent 1, a dry strength agent for paper is prepared from the enzymatically digested starch stated there and polymer 3. The strength agent has a viscosity of 122 mPa.s.

Strength agent 4

As described above under strength agent 1, a dry strength agent is prepared from the enzymatically digested potato starch and polymer 4. The viscosity of the strength agent is 61 mPa.s.

Strength agent 5

As described for the preparation of strength agent 1, a dry strength agent is prepared by mixing the enzymatically digested potato starch with polymer 5. A dry strength agent which has a viscosity of 36 mPa.s is obtained.

Strength agent 6

As described for the preparation of strength agent 1, a strength agent is prepared by mixing the enzymatically digested potato starch with polymer 6. The strength agent has a viscosity of 28 mPa.s.

Strength agent 7

As described for the preparation of strength agent 1, the enzymatically digested potato starch is mixed with polymer 7. This gives a dry strength agent having a viscosity of 31 mPa.s.

Strength agent 8

As described for the preparation of strength agent 1, the enzymatically digested potato starch is mixed with polymer 8. A dry strength agent having a viscosity of 25 mPa.s is obtained.

Strength agent 9

As described above under strength agent 1, natural potato starch is digested with one fourth of the amount of α-amylase (enzyme) stated above, an aqueous starch solution having a viscosity (measured at 45° C. in 7.5% strength aqueous solution) of 190 mPa.s resulting. The aqueous solution of the digested starch is then mixed at 45° C. with polymer 5 and used in the form of the aqueous solution of the mixture as a dry strength agent for paper. The viscosity is 210 mPa.s.

Strength agent 10

As described for the preparation of strength agent 1, natural potato starch is digested with only one tenth of the amount of enzyme stated there. The viscosity of the enzymatically digested potato starch is 443 (measured in 7.5% strength aqueous solution at 45° C.). Instead of the polymer 1 used there, the same amount of polymer 5 is then added to the solution of the enzymatically digested potato starch, the said solution having been cooled to 45° C. A dry strength agent for paper, which has a viscosity of 476 mPa.s, is obtained.

Strength agent 11 (comparison)

This is the enzymatically digested potato starch which is described above under strength agent 1 and which has a viscosity of 24 mPa.s (measured at 45° C. in 7.5% strength aqueous solution).

EXAMPLE 1

Sheets having a basis weight of 120 g/m$^2$ are produced in a Rapid-Köthen sheet former. The paper stock consists of 80% of mixed waste paper and 20% of bleached beech sulfite pulp which has been beaten to 50° SR (Schopper-Riegler) and to which the strength agent 1 described above has been added in an amount such that the solids content of strength agent 1 is 3.3%, based on dry paper stock. The pH of the stock suspension is brought to 7.5. The sheets made from this model stock are conditioned, after which the CMT value, the dry bursting pressure and the dry tear length are measured by the methods stated above. The results are shown in Table 1.

EXAMPLES 2 TO 10

Example 1 is repeated in each case with the exception that the strength agent stated in Table 1 is used instead of the strength agent 1 used in Example 1. The results thus obtained are shown in Table 1.

COMPARATIVE EXAMPLE 1

Example 1 is repeated without adding a dry strength agent, i.e. a stock consisting of 80% of mixed waste paper and 20% of bleached beech sulfite pulp beaten to 50° SR is drained in a Rapid-Köthen sheet former, sheets having a basis weight of 120 g/m$^2$ being obtained.

The results of the strength test on the resulting sheets are shown in Tables 1 and 2.

COMPARATIVE EXAMPLE 2

Comparative Example 1 is repeated, except that 3%, based on dry fiber, of natural potato starch are added to the paper stock. The strengths of the resulting paper sheets are shown in Table 1.

COMPARATIVE EXAMPLE 3

Comparative Example 2 is repeated, except that the natural potato starch is replaced by the same amount of strength agent 11. The strengths of the resulting sheets are shown in Table 1.

TABLE 1

| | Strength agent no. added to paper stock | CMT value [N] | Dry bursting pressure [kPa] | Dry tear length [m] |
|---|---|---|---|---|
| Example | | | | |
| 1 | 1 | 165 | 164 | 3211 |
| 2 | 2 | 159 | 161 | 3399 |
| 3 | 3 | 148 | 166 | 3412 |
| 4 | 4 | 152 | 161 | 3225 |
| 5 | 5 | 168 | 163 | 3272 |
| 6 | 6 | 163 | 167 | 3328 |
| 7 | 7 | 155 | 165 | 3135 |
| 8 | 8 | 158 | 162 | 3124 |
| 9 | 9 | 171 | 165 | 3439 |
| 10 | 10 | 178 | 171 | 3535 |
| Comparative Example | | | | |
| 1 | — | 115 | 126 | 2658 |
| 2 | Natural potato starch | 121 | 129 | 2732 |
| 3 | 11 | 116 | 128 | 2703 |

EXAMPLE 11

Paper having a basis weight of 120 g/m$^2$ and a width of 68 cm is made on a test paper machine at a speed of 50 m/min. The paper stock used consists of 80% of mixed waste paper and 20% of bleached sulfite pulp having a freeness of 56° SR. Prior to sheet formation, 3.3%, based on dry paper stock, of strength agent 9 are added to the paper stock. The backwater has a pH of 7.3. The strengths of the resulting paper are shown in Table 2.

EXAMPLE 12

Example 11 is repeated, except that the same amount of strength agent 10 is used. The strengths of the resulting paper are shown in Table 2.

COMPARATIVE EXAMPLE 4

On the test paper machine described in Example 11, paper having a basis weight of 120 g/m$^2$ is made from a paper stock which consists of 80% of mixed waste paper and 20% of bleached beech sulfite pulp having a freeness of 56° SR. The speed of the paper machine is set at 50 m/min, and the pH of the backwater is 7.3. The difference compared with Example 11 is that no dry strength agent is used. The strengths of the resulting paper are shown in Table 2.

COMPARATIVE EXAMPLE 5

Comparative Example 4 is repeated, except that 3%, based on dry fiber, of natural potato starch are furthermore added to the paper stock described there, prior to drainage. The strengths of the resulting paper are shown in Table 2.

COMPARATIVE EXAMPLE 6

Comparative Example 4 is repeated, except that 3%, based on dry fiber, of strength agent 11 are furthermore added to the paper stock described there, prior to drainage. The strengths of the resulting paper are shown in Table 2.

TABLE 2

| | Strength agent no. used | CMT value [N] | Dry bursting pressure [kPa] | Dry tear length [m] | COD value of back-water [mg/l] |
|---|---|---|---|---|---|
| Example | | | | | |
| 11 | 9 | 142 | 164 | 3703 | 213 |
| 12 | 10 | 150 | 172 | 3921 | 203 |
| Comparative Examples | | | | | |
| 4 | — | 97 | 129 | 2985 | 164 |
| 5 | Natural potato starch | 110 | 131 | 3149 | 386 |
| 6 | 11 | 101 | 130 | 3051 | 402 |

We claim:

1. A process for making paper, board and cardboard having high dry strength, which comprises adding an aqueous solution of a mixture of enzymatically digested starch having a viscosity of from 20 to 2,000 mPa.s (measured in 7.5% strength aqueous solution at 45° C.) and a cationic polymer which contains, as copolymerized characteristic monomers, (a) diallyldimethylammonium chloride, (b) N-vinylamine or (c) an N-vinylimidazoline of the formula

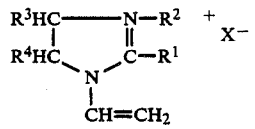

(I)

where $R^1$ is H, $C_1$–$C_{18}$-alkyl or

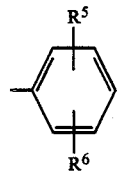

$R^5$ and $R^6$ are each H, $C_1$–$C_4$-alkyl or Cl, $R^2$ is H, $C_1$–$C_{18}$-alkyl,

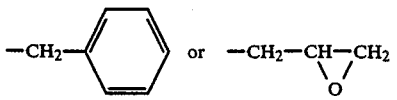

$R^3$ and $R^4$ are each H or $C_1$–$C_4$-alkyl and $X^-$ is an acid radical, and which has a K value of not less than 30, (determined according to H. Fikentscher in 5% strength aqueous sodium chloride solution at 25° C. and at a polymer concentration of 0.5% by weight), from 1 to 20 parts by weight of one or more cationic polymers being used per 100 parts by weight of enzymatically digested starch, as a dry strength agent to the paper stock and draining the paper stock with sheet formation.

2. A process as claimed in claim 1, wherein the cationic polymer used is a homopolymer of diallyldimethylammonium chloride, having a K value of from 60 to 180.

3. A process as claimed in claim 1, wherein the cationic polymer used is a hydrolyzed homopolymer of N-vinylformamide, from 70 to 100 mol % of the formyl groups of the polymer having been eliminated with formation of N-vinylamine units and the hydrolyzed polymer having a K value of from 75 to 170.

4. A process as claimed in claim 1, wherein the cationic polymer used is a hydrolyzed copolymer of (b1) from 95 to 10 mol % of N-vinylformamide and (b2) from 5 to 90 mol % of vinyl acetate or vinyl propionate, from 70 to 100 mol % of the formyl groups of the polymer having been eliminated with formation of N-vinylamine units and from 70 to 100 mol % of the acetyl and propionyl groups having been eliminated with formation of vinyl alcohol units, and the hydrolyzed copolymer having a K value of from 70 to 170.

5. A process as claimed in claim 1, wherein the cationic polymer used is a homopolymer of an unsubstituted or substituted N-vinylimidazoline or a copolymer thereof with acrylamide and/or methacrylamide, having a K value of from 80 to 220.

6. A process as claimed in claim 1, wherein the cationic polymer used is a copolymer of (c1) from 70 to 96.5% by weight of acrylamide and/or methacrylamide, (c2) from 2 to 10% by weight of a N-vinylimidazoline or N-vinyl-2-methylimidazoline and (c3) from 1.5 to 10% by weight of N-vinylimidazole, having a K value of from 80 to 220.

* * * * *